US008512417B2

(12) United States Patent
Miller et al.

(10) Patent No.: US 8,512,417 B2
(45) Date of Patent: Aug. 20, 2013

(54) FUNCTIONALIZED NANOPARTICLES AND METHODS OF FORMING AND USING SAME

(75) Inventors: John M. Miller, Eugene, OR (US); James E. Hulchison, Eugene, OR (US); Scoll F. Sweeney, Springfield, OR (US)

(73) Assignee: Dune Sciences, Inc., Eugene, OR (US)

( * ) Notice: Subject to any disclaimer, the term of this patent is extended or adjusted under 35 U.S.C. 154(b) by 0 days.

(21) Appl. No.: 13/129,373

(22) PCT Filed: Nov. 16, 2009

(86) PCT No.: PCT/US2009/064623

§ 371 (c)(1), (2), (4) Date: Jun. 16, 2011

(87) PCT Pub. No.: WO2010/057114

PCT Pub. Date: May 20, 2010

(65) Prior Publication Data

US 2011/0252580 A1 Oct. 20, 2011

Related U.S. Application Data

(60) Provisional application No. 61/114,933, filed on Nov. 14, 2008, provisional application No. 61/117,800, filed on Nov. 25, 2008.

(51) Int. Cl.
*D06M 11/00* (2006.01)

(52) U.S. Cl.
USPC ..... 8/116.1; 8/115.51; 8/115.54; 442/117; 442/123; 442/152; 442/153; 544/181

(58) Field of Classification Search
USPC ..... 8/115.51
See application file for complete search history.

(56) References Cited

U.S. PATENT DOCUMENTS

| | | | |
|---|---|---|---|
| 5,849,311 | A | 12/1998 | Sawan et al. |
| 5,869,073 | A | 2/1999 | Sawan et al. |
| 6,013,106 | A | 1/2000 | Tweden et al. |
| 6,410,765 | B1 | 6/2002 | Wellinghoff et al. |
| 6,454,813 | B1 | 9/2002 | Chan |
| 6,461,386 | B1 | 10/2002 | Chan et al. |

(Continued)

FOREIGN PATENT DOCUMENTS

| | | | |
|---|---|---|---|
| KR | 10-2006-0036971 | A | 5/2006 |
| WO | 2006/124769 | A2 | 11/2006 |
| WO | 2008/054338 | A2 | 5/2008 |

OTHER PUBLICATIONS

Becheri, Alessio et al., "Synthesis and Characterization of Zinc Oxide Nanoparticles: Application to Textiles as UV-Absorbers," J Nanopart Res, 2008, vol. 10, pp. 679-689.

(Continued)

*Primary Examiner* — Harold Pyon
*Assistant Examiner* — Katie L Hammer
(74) *Attorney, Agent, or Firm* — Schwabe, Williamson & Wyatt

(57) ABSTRACT

Embodiments herein provide a nanoparticle, such as a metal nanoparticle, coupled to a linker molecule to form a nanoparticle-linker construct. In an embodiment, a nanoparticle-linker construct may be further bound to a substrate to take advantage of one or more properties of the nanoparticle. In an embodiment, a functionalized nanoparticle (a nanoparticle having a reactive functionality) may be bound to a linker to form a functionalized nanoparticle-linker construct which may in-turn be bound to a substrate.

9 Claims, 7 Drawing Sheets

(56) References Cited

U.S. PATENT DOCUMENTS

| | | | | |
|---|---|---|---|---|
| 6,482,424 | B1 | 11/2002 | Gabbay | |
| 6,548,168 | B1 | 4/2003 | Mulvaney et al. | |
| 6,579,539 | B2 | 6/2003 | Lawson et al. | |
| 6,584,668 | B2 | 7/2003 | Green et al. | |
| 6,605,751 | B1 | 8/2003 | Gibbins et al. | |
| 6,607,994 | B2 | 8/2003 | Soane et al. | |
| 6,645,569 | B2 | 11/2003 | Cramer et al. | |
| 6,649,138 | B2 | 11/2003 | Adams et al. | |
| 6,660,058 | B1 | 12/2003 | Oh et al. | |
| 6,660,152 | B2 | 12/2003 | Nayfeh et al. | |
| 6,660,381 | B2 | 12/2003 | Halas et al. | |
| 6,696,585 | B1 | 2/2004 | Wellinghoff et al. | |
| 6,712,997 | B2 | 3/2004 | Won et al. | |
| 6,720,006 | B2 | 4/2004 | Hanke et al. | |
| 6,821,936 | B2 | 11/2004 | Green et al. | |
| 6,872,971 | B2 | 3/2005 | Hutchinson et al. | |
| 6,897,349 | B2 | 5/2005 | Gibbins et al. | |
| 6,986,943 | B1 | 1/2006 | Cook et al. | |
| 7,030,271 | B2 | 4/2006 | Wessels et al. | |
| 7,048,771 | B2 | 5/2006 | Sun et al. | |
| 7,078,060 | B2 | 7/2006 | Burrell et al. | |
| 7,118,761 | B2 | 10/2006 | Canada et al. | |
| 7,169,832 | B2 | 1/2007 | Poppe et al. | |
| 7,232,777 | B1 | 6/2007 | Van Hyning | |
| 7,270,694 | B2 | 9/2007 | Li et al. | |
| 7,291,570 | B1 | 11/2007 | Green et al. | |
| 7,306,777 | B2 | 12/2007 | Bringley et al. | |
| 7,329,301 | B2 | 2/2008 | Chang et al. | |
| 7,335,613 | B2 | 2/2008 | Cottrell et al. | |
| 7,364,716 | B2 | 4/2008 | Denisyuk et al. | |
| 7,422,759 | B2 | 9/2008 | Kepner et al. | |
| 7,479,516 | B2 | 1/2009 | Chen et al. | |
| 7,494,608 | B2 | 2/2009 | Li et al. | |
| 7,524,630 | B2 | 4/2009 | Tan et al. | |
| 7,576,255 | B2 | 8/2009 | Gibbins et al. | |
| 7,610,074 | B2 | 10/2009 | Boppart et al. | |
| 7,708,800 | B2 | 5/2010 | He et al. | |
| 7,776,425 | B2 | 8/2010 | Kalkan et al. | |
| 7,799,425 | B2 | 9/2010 | Chikamori et al. | |
| 7,807,199 | B2 | 10/2010 | Allen et al. | |
| 7,862,624 | B2 | 1/2011 | Tran | |
| 7,919,015 | B2 | 4/2011 | Li et al. | |
| 2002/0132361 | A1* | 9/2002 | Vossmeyer et al. | 436/151 |
| 2002/0192476 | A1 | 12/2002 | Kambe et al. | |
| 2003/0013369 | A1 | 1/2003 | Soane et al. | |
| 2004/0052957 | A1 | 3/2004 | Cramer et al. | |
| 2004/0091417 | A1 | 5/2004 | Yadav | |
| 2004/0173362 | A1 | 9/2004 | Waithman et al. | |
| 2005/0008676 | A1 | 1/2005 | Qiu et al. | |
| 2005/0058835 | A1 | 3/2005 | Howdle et al. | |
| 2005/0058844 | A1 | 3/2005 | Rubner et al. | |
| 2005/0203237 | A1 | 9/2005 | Dekkers et al. | |
| 2005/0226967 | A1 | 10/2005 | Bringley et al. | |
| 2006/0006678 | A1 | 1/2006 | Herron, Jr. | |
| 2006/0035087 | A1 | 2/2006 | Yadav et al. | |
| 2006/0057191 | A1 | 3/2006 | Wellinghoff | |
| 2006/0113530 | A1 | 6/2006 | Wessels et al. | |
| 2006/0189113 | A1 | 8/2006 | Vanheusden et al. | |
| 2006/0286684 | A1 | 12/2006 | Brennan et al. | |
| 2007/0003603 | A1 | 1/2007 | Harandikar et al. | |
| 2007/0029195 | A1 | 2/2007 | Li et al. | |
| 2007/0099357 | A1 | 5/2007 | Li et al. | |
| 2007/0184079 | A1 | 8/2007 | Gabbay | |
| 2007/0202342 | A1 | 8/2007 | Whiteford et al. | |
| 2007/0207335 | A1 | 9/2007 | Karandikar et al. | |
| 2007/0243237 | A1 | 10/2007 | Khaled et al. | |
| 2007/0259196 | A1 | 11/2007 | Ruhle et al. | |
| 2007/0292486 | A1 | 12/2007 | Sen et al. | |
| 2007/0293800 | A1 | 12/2007 | McMaken et al. | |
| 2008/0020127 | A1 | 1/2008 | Whiteford et al. | |
| 2008/0021212 | A1 | 1/2008 | Whiteford et al. | |
| 2008/0045736 | A1 | 2/2008 | Ying et al. | |
| 2008/0118540 | A1 | 5/2008 | Roe et al. | |
| 2008/0147019 | A1 | 6/2008 | Song et al. | |
| 2008/0193496 | A1 | 8/2008 | Gabbay | |
| 2008/0237126 | A1 | 10/2008 | Hoek et al. | |

OTHER PUBLICATIONS

Gao, Yuan et al., "Recent Advances in Antimicrobial Treatments of Textiles," Textile Research Journal, Mar. 5, 2008, vol. 78, No. 1, pp. 60-72.

Xie, Jin et al., "Linking Hydrophilic Macromolecules to Monodisperse Magnetite (Fe3O4) Nanoparticles via Trichloro-s-triazine," Chem. Mater., 2006, vol. 18, pp. 5401-5403.

Stobie, Niall et al., "Prevention of *Staphylococcus epidermidis* Biofilm Formation Using a Low-temperature Processed Silver-doped Phenyltriethoxysilane Sol-gel Coating," Science Direct, Biomaterials, 2008, vol. 29, pp. 963-969.

Lee, H. J. et al., "Antibacterial Effect of Nanosized Silver Colloidal Solution on Textile Fabrics," Journal of Materials Science, 2003, vol. 38, pp. 2199-2204.

Chung, Y. et al., "The Surface Modification of Silver Nanoparticles by Phosphoryl Disulfides for Improved Biocompatibility and Intracellular Uptake," Biomaterials, 2008, vol. 29, pp. 1807-1816.

Pawsey, S. et al., "Self-Assembly of Carboxyalkylphosphonic Acids on Metal Oxide Powders," Langmuir 2002, vol. 18, pp. 5205-5212.

Holland, G. P., et al., "NMR Characterization of Phosphonic Acid Capped SnO2 Nanoparticles," Chemistry of Materials, 2007, vol. 19, pp. 2519-2526.

Shon, Y. S., et al., "Aqueous Synthesis of Alkanethiolate-Protected Ag Nanoparticles Using Bunte Salts," Langmuir, 2004, vol. 20, pp. 6626-6630.

Kar, S., et al., "COCHO-Modified Oxides Nanoparticles by Using Phosphonic Acid as Grafting Agent," Tetrahedron Letters, 2003, vol. 44, pp. 5617-5619.

Solomon, Sally D., et al., "Synthesis and Study of Silver Nanoparticles," J. Chem Educ, 2007, vol. 84, No. 2, pp. 322-325.

* cited by examiner

| Sample | Description | ppm Ag* (loading) | log Reduction (antimicrobial) |
|---|---|---|---|
| DS-08-1016 | Rayon | 216.25 | 3.16 |
| DS-08-1017 | Rayon | 269.66 | 3.41 |
| DS-08-1018 | Rayon | 221.99 | 3.98 |
| DS-08-1019 | Rayon | 271.09 | 2.5 |
| | Average | 244.75 | 3.26 |
| | Std. Dev. | 29.69 | 0.61 |

FUNCTIONALIZED NANOPARTICLES AND METHODS OF FORMING AND USING SAME

CROSS REFERENCE TO RELATED APPLICATIONS

The present application claims priority to U.S. Provisional Patent Application No. 61/114,933, filed Nov. 14, 2008, entitled "Functionalized Metal Nanoparticle and Method of Forming Same," and to U.S. Provisional Patent Application No. 61/117,800, filed Nov. 25, 2008, entitled "Attachment of Nanoparticles to Cellulosic Substrates and Similarly Reactive Substrates," the entire disclosures of which are hereby incorporated by reference in their entirety.

TECHNICAL FIELD

Embodiments herein relate to the field of nanotechnology, and, more specifically, to functionalized nanoparticles and methods of forming and using the same.

BACKGROUND

While demand for nanoparticle-enhanced products has increased over time, developing techniques for integrating nanoparticles into products has remained a challenge.

The current processes used to isolate nanoparticles, in particle metal nanoparticles, offer limited functionality for attachment to substrates, and very little if any substrate specificity. Current approaches result in inefficient uses of high value materials, relatively low reliability, and dislodgment of the nanoparticles during high stress periods. Although there are many approaches to attach nanoparticles to various substrates, current approaches fail to ensure that the nanoparticles remain firmly affixed to surfaces under high stress conditions such as exposure to high temperature, agitation, or repeated washing.

Despite the challenges, various markets are now emerging that take advantage of the properties provided by nanoparticles. For example, silver nanoparticle decorated textiles are an emerging market. The silver nanoparticles serve to reduce microbial growth in fabrics. Current technologies typically rely upon precipitation or coprecipitation of silver onto fabrics, in situ formation of nanoparticles, or extrusion of silver with textile fibers. In other techniques, silver and other nanoparticles may be attached to textiles using electrostatic interactions. Silver nanoparticles have also been sprayed onto textiles. However, for decorated textiles using such prior techniques, recent studies have shown that the silver may be leached from the garments.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
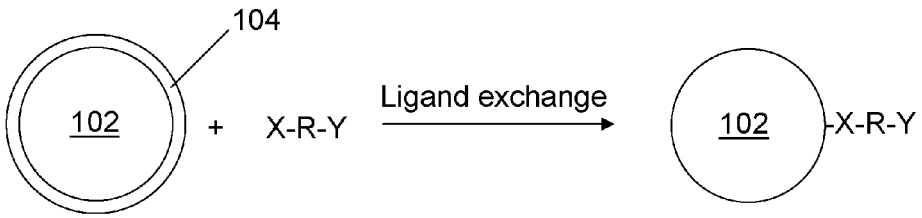
FIG. 1 illustrates an exemplary ligand exchange process in accordance with an embodiment.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact or chemically bound to each other, for example with a hydrogen bond, Van der Waals bond, electrostatic bond, covalent bond, or other such bond. "Coupled" may mean that two or more elements are in direct physical contact; however, "coupled" may also mean that two or more elements are not in direct physical contact with each other, but yet are still associated or still cooperate/interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments, are synonymous.

Embodiments herein provide a nanoparticle, such as a metal nanoparticle, coupled to a linker molecule to form a nanoparticle-linker construct. In an embodiment, a nanoparticle-linker construct may be further bound to a substrate to take advantage of one or more properties of the nanoparticle. In an embodiment, a functionalized nanoparticle (a nanoparticle having a reactive functionality) may be bound to a linker to form a functionalized nanoparticle-linker construct which may in-turn be bound to a substrate.

In embodiments, suitable nanoparticles include, but are not limited to, gold, silver, copper, platinum, palladium, zinc oxide, titania, zirconia, silica, semiconducting quantum dots, etc. In embodiments, nanoparticles may have a size (diameter) ranging from 1-1000 nanometers, such as 1-100 nanometers, for example 1-10 nanometers, although other sizes may also be used. As disclosed herein, nanoparticles are generally substantially spherical in shape, but, in embodiments, may be one or more other shapes, such as rods, prisms, cubes, wires, etc.

In an embodiment, a nanoparticle may be a metal nanoparticle. For the purposes of the present description, the term "metal nanoparticle" refers to metal nanoparticles, metal oxide nanoparticles, and nanoparticles having a metal core and a metal oxide shell. Suitable metals for use in a metal nanoparticle herein include, but are not limited to, aluminum, iron, silver, zinc, gold, copper, cobalt, nickel, platinum, manganese, rhodium, ruthenium, palladium, titanium, vanadium, chromium, molybdenum, cadmium, mercury, calcium, zirconium, and iridium, or oxides thereof.

For the purposes of the present description, the term "linker molecule" refers to one or more molecules with two or more functional groups at terminal ends (bifunctional, trifunctional, etc.) configured to bind/link one or more nanoparticles to one or more substrates. In embodiments, suitable linker molecules may include a reactive functionality including, but not limited to, an azide, for example an acyl azide, vinyl chloride, cyanuric chloride, vinyl sulfone, and an isocyanate. As mentioned above, in an embodiment, a nanoparticle may be functionalized with a reactive functionality, such as an azide, for example an acyl azide, vinyl chloride, cyanuric chloride, vinyl sulfone, and an isocyanate. The functionalized nanoparticle may additionally bind to a separate linker molecule to attach the functionalized nanoparticle to the substrate.

In an embodiment, a linker molecule may have an affinity for a particular substrate, such as a cellulosic substrate and/or other similarly reactive substrates. Other suitable substrates include amide-containing polymers, nylon, polyesters, polyurethanes, etc. In embodiments, a suitable substrate may be one with one or more amide or amine groups and/or one or more alcohol groups.

For the purposes of the present description, the term "substrate" refers to any supporting material to which a nanoparticle or functionalized nanoparticle may be bound/linked by a linker molecule. In embodiments, a substrate may be bound to one type of nanoparticle, or a substrate may be bound to more than one type of nanoparticle. For example, a substrate may be bound to silver and copper nanoparticles in any suitable ratio and arrangement. In another example, an alumina substrate may be bound to copper and zinc oxide to provide certain properties, such as catalytic properties.

For the purposes of the present description, the term "cellulosic substrate" refers to materials comprising, at least in part, cellulose. Cellulosic substrates include, but are not limited to, cotton, linen, rayon, wood, paper, cardboard, cellophane, etc.

While certain embodiments herein are described with reference to cellulosic substrates, other substrates reactive to azides, vinyl chlorides, cyanuric chloride, vinyl sulfones, and/or isocyanates may also be utilized, such as wool, leather, nylon, etc.

Embodiments provide nanoparticle constructs, processes to functionalize nanoparticles via ligand exchange to introduce peripheral functionality to the nanoparticles, and application of the constructs/processes to various articles of manufacture to provide desired functionality. Applications of such arrangements are varied and include, but are not limited to, antimicrobial functionality, improved electronic, filtration, optical, magnetic, and catalytic systems, packaging materials, biosensors, etc.

An advantage of various disclosed embodiments is that nanoparticles, such as metal nanoparticles, may be attached to a substrate with a high degree of specificity and affinity. Additionally, stable constructs may be formed as a result. As such, in embodiments, exposure to high temperature, pressure, agitation, and/or repeated washing will not easily dislodge or weaken the bonds formed between the substrate, the linker, and the nanoparticle.

Nanoparticles in accordance with embodiments herein may be formed using any suitable desired process, whether a wet process or a dry process, a solution-based process or a solid/powder-based process.

One challenge in functionalization of nanoparticles is the removal of impurities that may impede functionalization and assembly of nanoparticles. Removal of impurities may be accomplished by a variety of known mechanisms, including, but not limited to diafiltration. In an embodiment, diafiltration may be utilized to a desired extent such that a weakly bound layer (passivating layer) may remain bound to a nanoparticle for use in a subsequent ligand exchange process. For the purposes of the present description, the term "passivating layer" refers broadly to a modified surface morphology of a nanoparticle that relatively reduces the reactivity of the surface of the nanoparticle, such as by forming an oxide layer on the surface of a metal nanoparticle or by coupling with certain weakly associated molecules. In embodiments, a passivating layer need not completely cover or encase the underlying nanoparticle.

To functionalize a nanoparticle, an exemplary ligand exchange method uses a weakly associated passivating layer adsorbed to the surface of the nanoparticle that is displaced by a linker molecule through ligand exchange. The presence of the weakly associated layer prevents the undesired aggregation or reaction of the nanoparticles. Once bound, a functionalized metal nanoparticle provides a relatively stable construct with at least one available/reactive terminal end of the linker molecule.

For the purposes of the present description, the term "ligand exchange" refers to a process by which weakly bound molecules on a nanoparticle surface are exchanged with nanoparticle active functional group(s) of a linker molecule.

Various processes described herein are advantageous because the linker molecules used may be selected based on the requirements of the substrate and the nanoparticle. In an embodiment, one terminal end of the linker molecule may be comprised of a functional group reactive to the nanoparticle, or to a reactive group of a functionalized nanoparticle, while another end of the linker molecule may be comprised of a functional group reactive to the substrate.

FIG. 1 illustrates an exemplary ligand exchange process in accordance with an embodiment. In FIG. 1, a nanoparticle 102 is provided with a weakly bound passivating layer 104. Through a ligand exchange process, a linker molecule may be exchanged for passivating layer 104. A linker molecule may have the general formula X—R—Y, where X represents a nanoparticle binding moiety comprising a sulfonic acid, phosphonic acid, carboxylic acid, dithiocarboxylic acid, phosphonate, sulfonate, thiol, carboxylate, dithiocarboxylate, amine, etc. such as $PO_3H_2$, $PO_3^{2-}$, $SO_3H$, $SO_3^-$, SH; Y represents a substrate binding moiety comprising an alcohol, carboxylic acid, amine, thiol, azide, quarternary amine, vinyl sulfone, sulfonic acid, phosphonic acid, dithiocarboxylic acid, alkyl, aryl, vinyl, or polymer, etc. such as SH, OH, $NH_2$, $CO_2H$; and R is selected from alkyl, aryl, vinyl, oligomer, polymer, etc. In embodiments, a nanoparticle binding moiety has an affinity for nanoparticle 102 that is greater than the affinity of the passivating layer 104 for nanoparticle 102 such that the differential affinity causes displacement of passivating layer 104 in exchange for the linker molecule.

In embodiments, the length of the linker molecules may be controlled and may range from 0.8 nanometers to 10 nanometers or more.

Figure 2A:
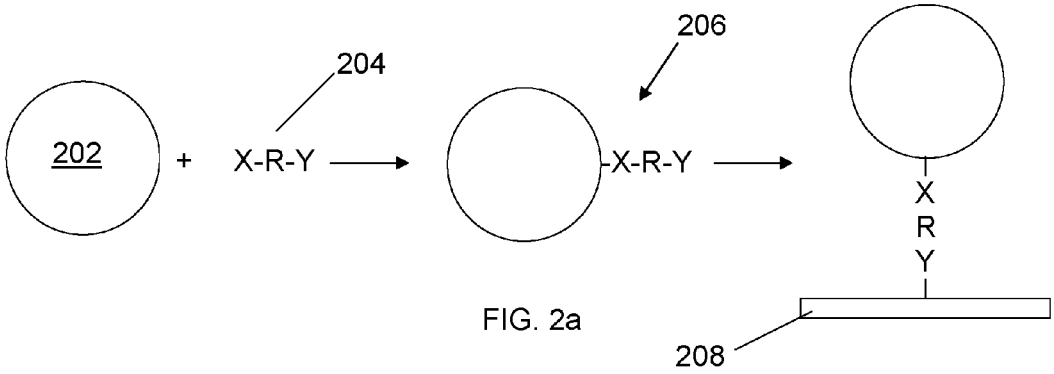
FIGS. 2*a* and 2*b* illustrate alternative nanoparticle functionalization methods and attachment to substrates in accordance with various embodiments.
Figure 2B:
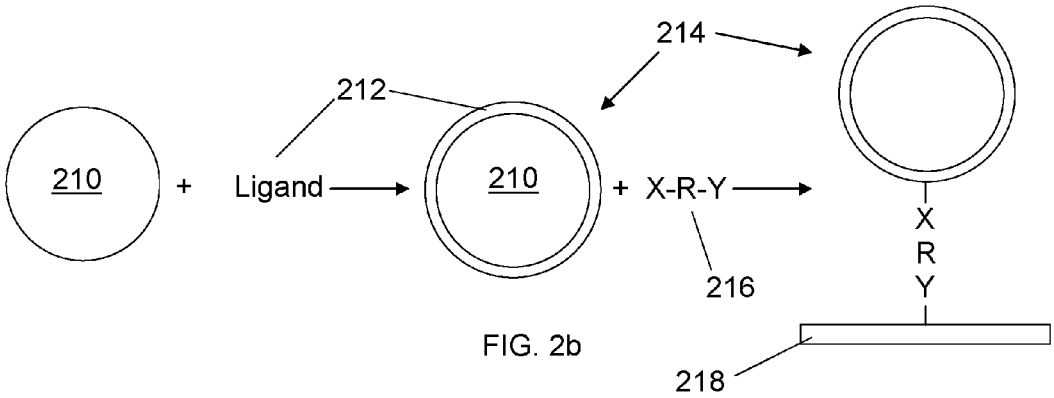

FIGS. 2*a* and 2*b* illustrate alternative nanoparticle functionalization methods and attachment to substrates. In FIG. 2*a*, nanoparticle 202 is coupled to a linker 204 designated X—R—Y to form a functionalized nanoparticle 206 (functionalized by the linker molecule). Functionalized nanoparticle 206 may then be bound to a substrate 208. In FIG. 2*b*, nanoparticle 210 is bound to a ligand 212 (linker, reactive functionality) to form a functionalized nanoparticle 214. Functionalized nanoparticle 214 may then be coupled to a linker 216 designated X—R—Y and bound to a substrate 218.

Methods described herein to impart reactive functionality to nanoparticles may occur in aqueous, nonaqueous, or biphasic conditions. Alkaline conditions may also be used. In embodiments, functionalization of nanoparticles may be accomplished by a variety of processes including, but not limited to, direct functionalization and sonochemical functionalization.

In an exemplary direct functionalization approach, diafiltered silver nanoparticles may be suspended in a dilute alcohol solution. Next, dichloromethane and from 1 to 5 equivalents of an organic soluble ligand may be added to the solution. After stirring for several hours, an exchange of the metal nanoparticles from the alcohol solution to the dichloromethane may be observed. Following ligand exchange, the organic layer may be isolated and extracted with dilute alcohol to remove excess free ligand.

In an exemplary sonochemical functionalization approach, silver nanoparticles that have been precipitated and resuspended in chloroform are briefly mixed with 1-5 equivalents of a water-soluble ligand in a dilute alcohol solution. The biphasic mixture may be placed into a sonicating bath for approximately ten minutes. Following ultrasonic agitation, the solution may be stirred for a period of ten minutes to several hours to complete functionalization, demonstrated via the exchange of the silver nanoparticles from the chloroformic to alcoholic phases. The alcoholic phase may then be isolated and diafiltered with water to remove excess free ligands.

While the above examples are described in relation to silver nanoparticles, other nanoparticles, including other metal nanoparticles, such as copper or cobalt nanoparticles, may be functionalized using similar methodologies.

In another exemplary functionalization method, nanoparticles passivated by polysorbate 20 (Tween-20) in aqueous conditions may be added to isopropyl alcohol and stirred. Next, mercaptopropyl phosphonic acid in water may be added to the solution and stirred until the solution clears. The solution may be stirred for approximately twenty minutes to ensure complete exchange. The solution may then be diafiltered to remove residual isopropyl alcohol and free ligand, yielding functionalized nanoparticles.

In another exemplary functionalization method, isopropyl alcohol, phosphonic acid and sodium hydroxide may be mixed. Next, a solution of nanoparticles passivated by, for example, polysorbate 20 (Tween-20) in water may be added to the mixture. After stirring for approximately twenty minutes, the solution may be diafiltered to remove residual isopropyl alcohol and free ligand, yielding functionalized nanoparticles.

Figure 3:
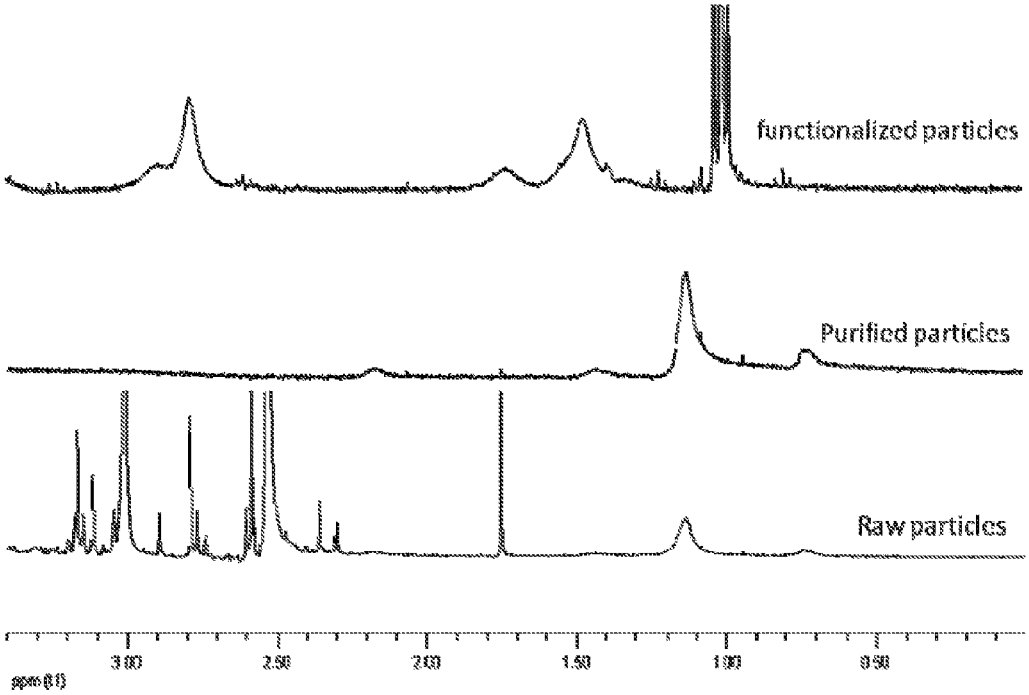
FIG. 3 illustrates results of NMR analysis of functionalized nanoparticles in accordance with an embodiment.

FIG. 3 illustrates results of NMR analysis of functionalized silver nanoparticles. To test the outcome of an exemplary method as described herein, $^1$H-NMR analysis was performed on the functionalized nanoparticles to confirm that ligand exchange occurred. In this exemplary method, silver nanoparticles comprising silver and silver oxide were functionalized. The ligand used during the present experiments contained functional groups that bonded to both the silver and the silver oxide. The presence of peaks characteristic of the ligand used for functionalization and the absence of peaks characteristic of the lost ligands suggests that functionalization of the nanoparticles occurred. FIG. 3 illustrates the raw material, the diafiltered material, and the functionalized material.

Figure 4:
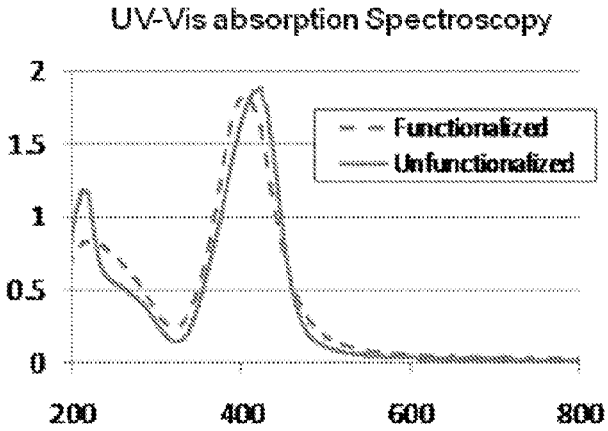
FIG. 4 illustrates UV-Vis absorption spectroscopy of both functionalized and unfunctionalized nanoparticles in accordance with an embodiment.

FIG. 4 illustrates UV-Vis absorption spectroscopy of both functionalized and unfunctionalized nanoparticles. The absorption spectra indicate that there is no significant change in plasmon absorption due to functionalization of the nanoparticles.

After a nanoparticle is functionalized via the methods described herein and attached to the substrate through the linker molecule, the unused linker molecules may later be desorbed from the exposed surface of the nanoparticle. Desorption of the linker molecule may provide additional or enhanced functionality to the nanoparticle by removing unbound or incompletely bound extraneous linker molecules from the exposed surface of the functionalized nanoparticle. In an embodiment, to desorb the linker molecule from the nanoparticle, exposure to high temperature, UV/ozone, ozonolysis, or plasma may be utilized.

In an exemplary embodiment, after desorption of extraneous linker molecules from a metal nanoparticle, the frequency and amount of metal ions released by the metal nanoparticle may be controlled based on the requirements of the article or device. In an embodiment, the frequency of metal ions released by a functionalized metal nanoparticle may be from 0 to 250 ppm/day or more.

Figure 5:
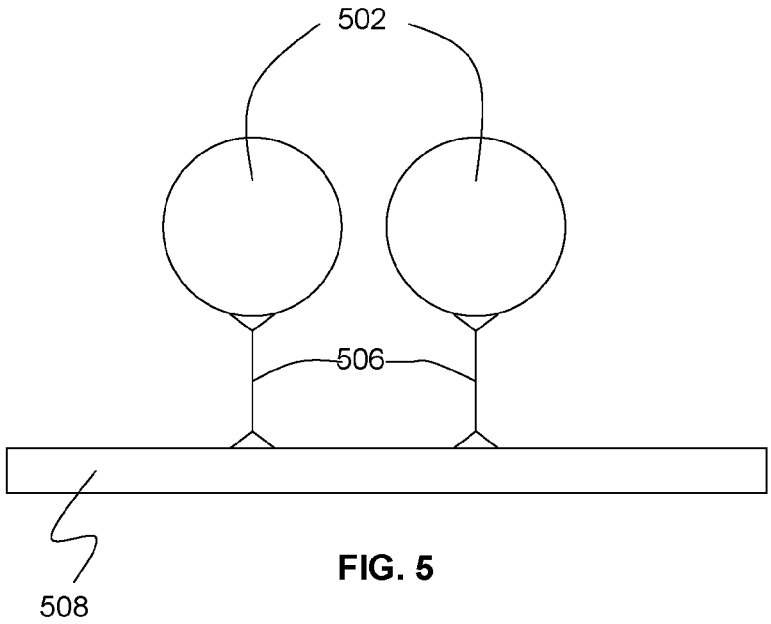
FIG. 5 illustrates nanoparticles, functionalized or unfunctionalized, bound to a substrate via a linker molecule in accordance with various embodiments.

As discussed above, nanoparticles may be bound to a variety of substrates. FIG. 5 provides an illustrative embodiment in which nanoparticles 502, whether separately functionalized or not, are bound to a substrate 508 via a linker molecule 506. Nanoparticles may be bound to a substrate by any suitable method.

In an exemplary embodiment, functionalized nanoparticles may be bound to the surface of a substrate using a second linker molecule that couples the reactive surface of the functionalized nanoparticles to reactive groups on the surface of the substrate.

In an exemplary method, functionalized nanoparticles may be formed in liquid. Functionalized nanoparticles may be added to a solution containing a secondary linker molecule and a substrate may be immersed in the solution. This solution may then be heated or otherwise exposed to an external stimulus, such as heat, vibration, microwaves, or sonication, that will encourage/activate the secondary linker molecule to bind to both the functionalized nanoparticle and the substrate. The unbound excess may be rinsed. The device may then be dried, as desired.

In embodiments, the deposition or other coupling of nanoparticles to a substrate may be controlled. The design of the attachment may allow for tuning of the nanoparticle loading onto the surface of the substrate. For example, nanoparticles may be coupled to a substrate randomly or in an ordered or patterned manner. In embodiments, the density, spacing, or distribution of the nanoparticles may be controlled. Nanoparticles may be coupled to a substrate in a defined array, such as a density gradient. In embodiments, control of the density/distribution of nanoparticles may be achieved using an eluting agent, a blocking agent, a mask, a surface pretreatment or post-treatment, printing, or other suitable process.

Figure 6:
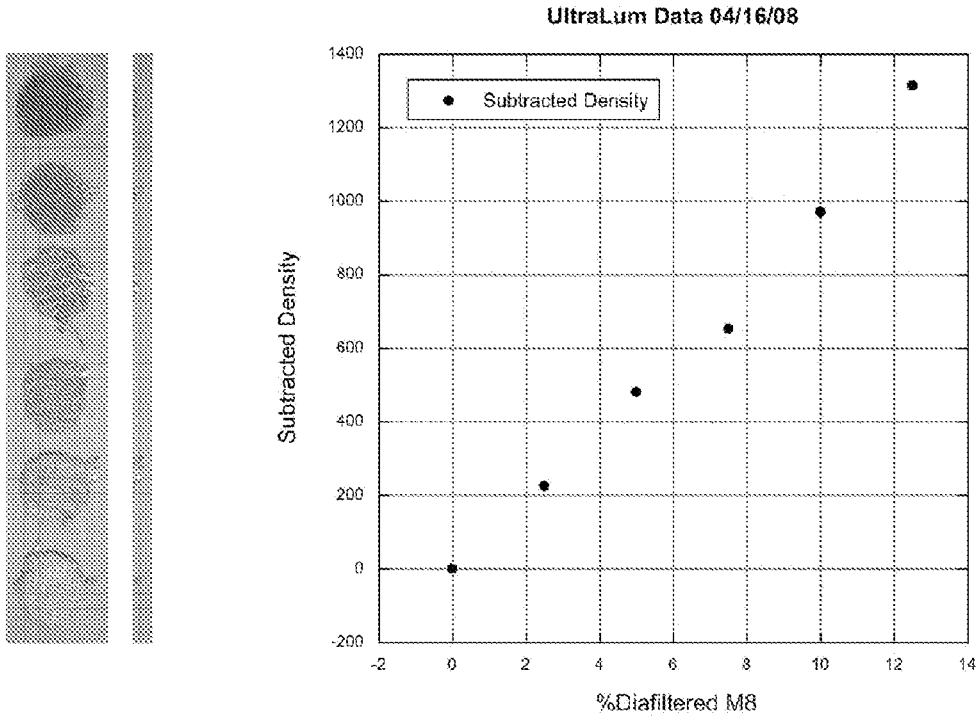
FIG. 6 illustrates the ability to tailor the loading of silver particles onto rayon fabric by concentration of silver in accordance with an embodiment.

FIG. 6 illustrates the ability to tailor the loading of silver particles onto rayon fabric by concentration of silver. Subtracted density is defined as the difference in reflected light of the white fabric versus the treated fabrics. Hence, the darkest fabric has the highest substracted density since it reflects the least amount of light.

Embodiments herein may be used in a variety of applications.

For example, treating medical and nonmedical devices with certain functionalized nanoparticles, such as functionalized metal nanoparticles, for example silver nanoparticles, may provide antimicrobial and antibacterial functionality. Such medical devices may include stents, catheters, abdominal plugs, breast implants, adhesive films, contact lenses, lens cases, fibrous wound dressings, cotton gauzes, bandages, wound products, etc.

In another embodiment, functionalized nanoparticles, such as silver nanoparticles, may provide durable antimicrobial properties to certain textiles such as undergarments, socks, panty hose, swim apparel, snow sport apparel, hiking apparel, athletic apparel, hunting apparel, etc. as well as related equipment/accessories.

Figure 7:
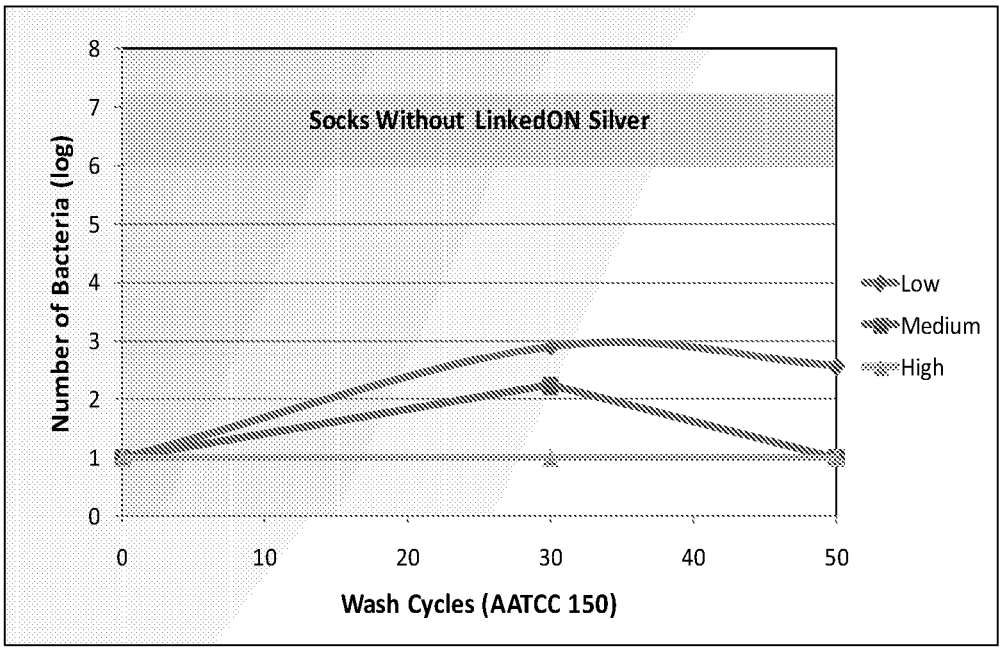
FIG. 7 illustrates antimicrobial properties of nylon socks treated with silver nanoparticles using a bifunctional linker as a function of laundering cycles in accordance with an embodiment.

FIG. 7 illustrates antimicrobial properties of nylon socks treated with functionalized silver nanoparticles as a function of laundering cycles. Data is reported for bacterial challenge of methicillin resistant *S. aureus*. The socks were inoculated with MRSA at a concentration of log 5. After 24 hours, the concentration was measured again. In the control samples, the number of bacteria had increased to log 6 or log 7. The treated samples showed a log reduction of greater than 5 corresponding to a 99.999% reduction for all three loading levels. The low concentration corresponds to 75 ppm while the high concentration corresponds to 120 ppm.

Figure 8:
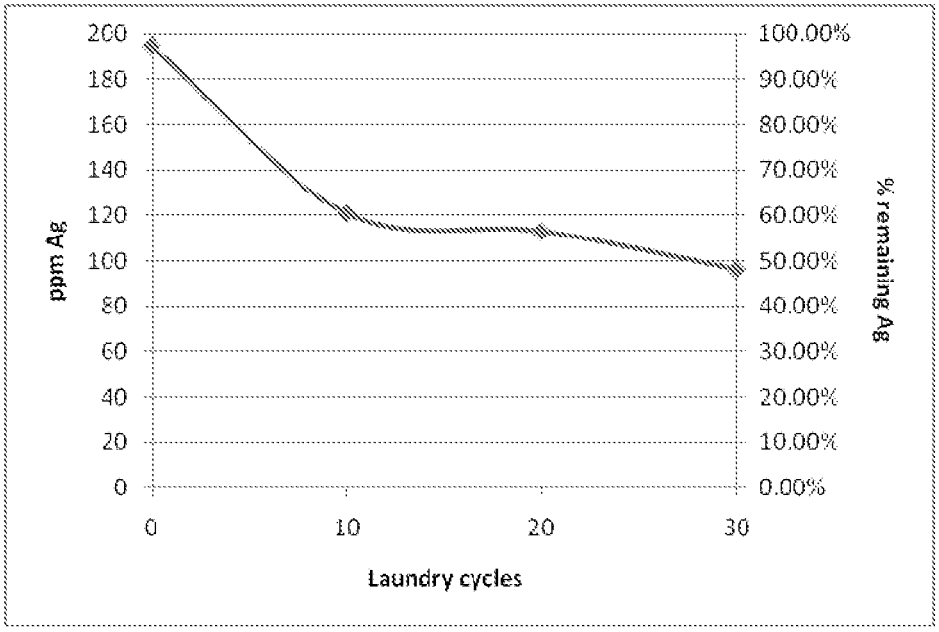
FIG. 8 illustrates silver retention versus washing cycles for a rayon sample treated with functionalized nanoparticles in accordance with an embodiment.
Figures 9, 10:
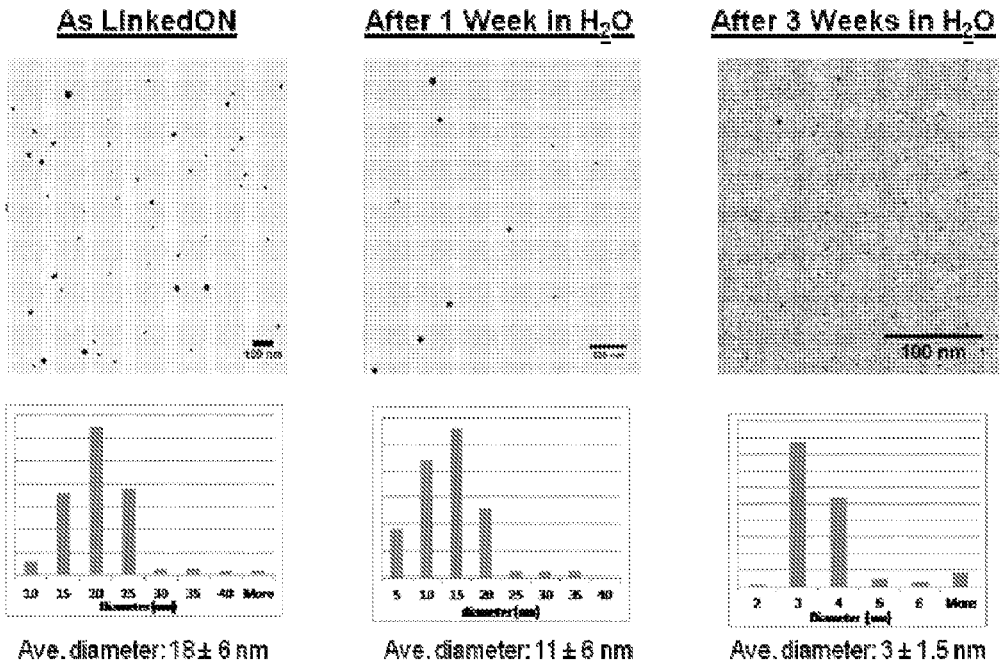
FIG. 9 illustrates a TEM image of silver particles linked through a bifunctional linker to amine groups on a TEM grid in accordance with an embodiment.
FIG. 10 illustrates the reproducibility of loading levels for silver nanoparticles on different rayon fabric samples prepared using different coating batches, and includes the antimicrobial log reduction in bacteria for MRSA for each of these samples, in accordance with embodiments.

FIG. 8 illustrates silver retention versus washing cycles for a rayon sample treated with functionalized nanoparticles in accordance with an embodiment. FIG. 8 shows that there is a slow release of silver during repeated washing evidencing the durability of the methodologies described herein. FIG. 9 illustrates a TEM image of silver particles linked through a bifunctional linker to amine groups on a TEM grid. Grids immersed in water for 3 weeks show a reduction in size consistent with slow elution of silver ions, but permanent bonding of the nanoparticle to the substrate.

Embodiments may also use the antimicrobial properties of certain functionalized nanoparticles on metal surfaces such as a doorknob to reduce exposure to microbes during general use. Through the methods described herein, functionalized nanoparticles may be attached to a metal substrate, such as used to construct a doorknob, via linker molecules to provide antimicrobial functionality. Other embodiments that may utilize functionalized nanoparticles attached to metal surfaces include kitchen appliances, desks, storage containers, cooking accessories, cutlery, writing utensils, keys, faucets, razors, laboratory instruments, etc.

In an embodiment, metal nanoparticles may be attached to metal oxide surfaces as catalysts using the nanoparticle-linker-substrate methodologies described herein. A carboxylate terminated nanoparticle may be bound to a metal oxide surface that has good catalytic properties. In an example, copper or cobalt nanoparticles may be functionalized with aminocaproic acid (amine-$C_5$-carboxylate) such that the amine group binds to the metal particle surface and the carboxylate end reacts, such as with ZnO, to clear the solution of nanoparticles.

In other embodiments, certain consumer products may benefit from antimicrobial properties imparted by functionalized nanoparticles including cutting boards, utensils, cleaners, disinfectants, kitchen surfaces, sponges, floor surfaces, kitchen products, etc. Similarly, personal care products may be imparted with antimicrobial properties including toothbrushes, lotions, ointments, gels, aerosol sprays, deodorants, feminine care products, etc.

In embodiments, functionalized nanoparticles may be integrated into cellulose-based materials, such as clothing. For example, the antimicrobial and antifungal properties of silver or copper nanoparticles may improve resistance of cellulosic material to fungus, termites, and mold. Linker molecules of the present invention may be adjusted to bind to cellulosic material. Certain wood products that may utilize embodiments herein include but are not limited to wood construction materials, writing utensils, furniture, cabinets, outdoor products, paper, and paper products.

In an embodiment, nanoparticles that have been functionalized with bifunctional linkers may be attached to cellulosic substrates through the covalent attachment of a nanoparticle to hydroxyl groups on cellulosic substrates. Such an approach may bind the nanoparticles to the surface of the fabrics for an extended period, providing a long lasting, durable coating. In addition, the covalent bonds may prevent unintentional release of the nanoparticles. Further, in an embodiment, the methods for attaching nanoparticles to a cellulosic substrate are minimal, inexpensive, and scalable and may utilize similar chemistry already used in the textile industry for dye chemistry.

Covalent attachment of nanoparticles to cellulosic substrates using bifunctional linkers offers the possibility of producing long lasting nanoparticle coatings on cellulosic substrates. In an exemplary situation, nanoparticles containing azide reactive functionality may be diluted in neutral aqueous or alkaline media. In an embodiment, the cellulosic substrate to be functionalized may be introduced to the dilute nanoparticle solution and allowed to absorb the nanoparticles, optionally at an elevated temperature. Following this absorption, the reactive azide, such as cyanuric chloride, may be added to the mixture. After a period of reaction time, such as thirty minutes, the cellulosic substrate may be removed from the solution and rinsed.

In an embodiment, functionalized nanoparticles having a reactive group, such as an azide, may be mixed with a linker molecule to form a construct, and then the construct may be combined with the cellulosic substrate onto which the functionalized nanoparticles are intended to be attached. In this embodiment, a more homogeneous mixture is provided, allowing for more even coverage of the functionalized nanoparticles over the entirety of the cellulosic substrate. In other examples, the substrate onto which the functionalized nanoparticles are intended to be attached may be mixed with the linker molecules in aqueous or alkaline media, followed by addition of the functionalized nanoparticles.

FIG. 10 illustrates the reproducibility of loading levels for silver nanoparticles on different rayon fabric samples prepared using different coating batches in accordance with embodiment. FIG. 10 also includes the antimicrobial log reduction in bacteria for MRSA for each of these samples. The results show reproducibility of loading and beneficial antimicrobial reduction.

Figure 11:
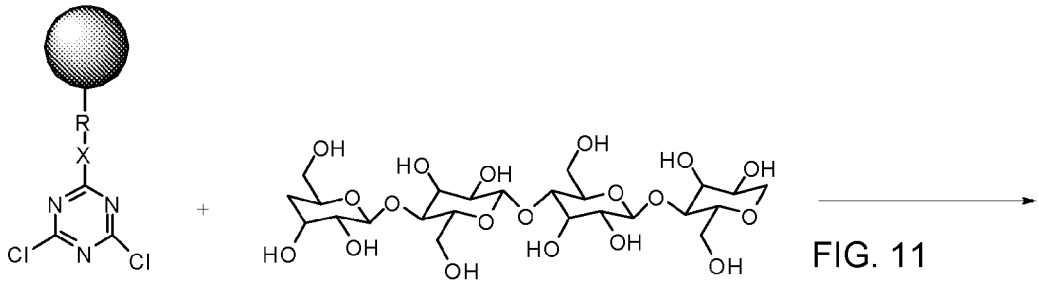
FIGS. 11, 12, 13, and 14 illustrate a representative attachment scheme to attach a nanoparticle to a cellulosic substrate in accordance with various embodiments.
Figure 12:
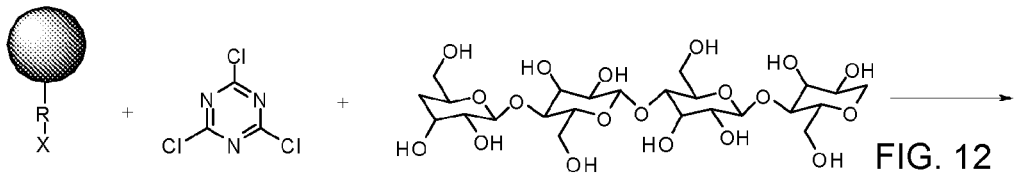
Figure 13:
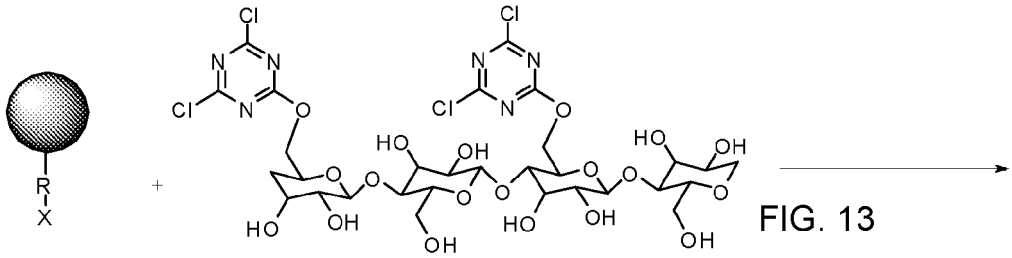
Figure 14:
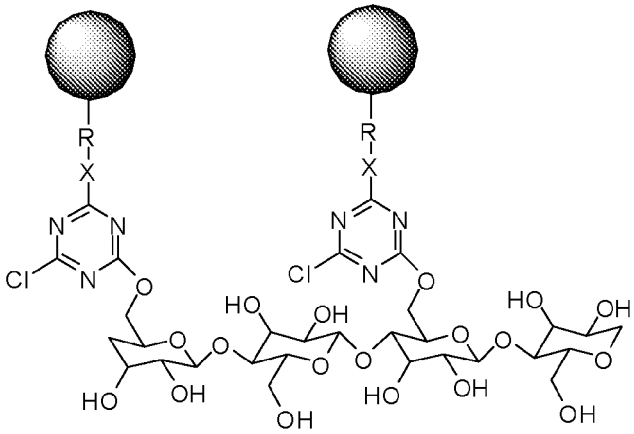

FIGS. 11, 12, 13, and 14 illustrate a representative attachment scheme to attach a nanoparticle to a cellulosic substrate. FIG. 11 illustrates a nanoparticle functionalized with a bifunctional linker containing a dichlorotriazine peripheral functionality reacted with a cellulosic substrate. FIG. 12 illustrates a nanoparticle functionalized with a bifunctional linker containing a cyanuric chloride binding peripheral functionality reacted simultaneously with cyanuric chloride and a cellulosic substrate. FIG. 13 illustrates a nanoparticle functionalized with a bifunctional linker containing a cyanuric chloride binding peripheral functionality reacted with a cellulosic substrate pretreated with cyanuric chloride. FIG. 14 illustrates a final product, wherein a nanoparticle is attached to a cellulosic substrate via a bifunctional linker containing a triazinyl moiety.

Figure 15:
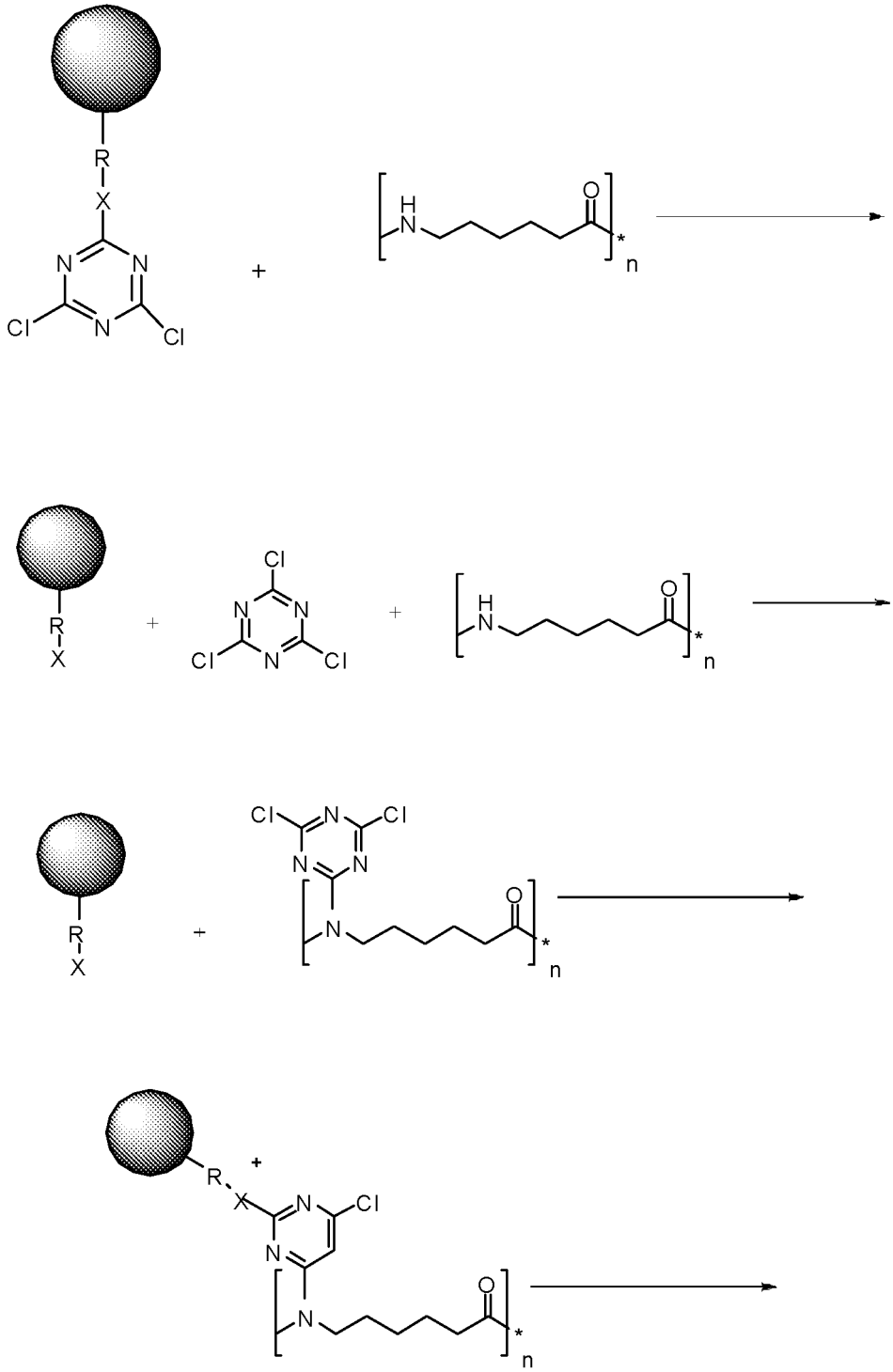
FIG. 15 illustrates an attachment scheme for amide-containing polymers such as nylon in accordance with various embodiments.

In a similar fashion, FIG. 15 illustrates an attachment scheme for amide-containing polymers such as nylon.

The following examples demonstrate specific approaches for the attachment of silver nanoparticles to rayon cloth, provided as examples of embodiments described herein.

In one method, 100 μl of silver nanoparticles functionalized with polysorbate 20 (Tween 20) may be added to 1 mL of water and mixed. To this, a 1 $cm^2$ sample of rayon cloth may be added. The mixture may be heated to 40° C. After 5 minutes, 50 μL of a 10 mg/mL solution of cyanuric chloride may be added. The solution may be heated at 40° C. for thirty minutes. The solution may then be removed and the fabric may be rinsed five times with water to yield the final silver nanoparticle impregnated cloth.

In a second method, 100 μl of silver nanoparticles functionalized with (2-{2-[2-(2-Hydroxy-ethoxy)-ethoxy]-ethylsulfanyl}-ethyl)-phosphonic acid may be added to 1 mL of water and mixed. To this, a 1 $cm^2$ sample of rayon cloth may be added. The mixture may be heated to 40° C. After 5 minutes, 50 μL of a 10 mg/mL solution of cyanuric chloride may be added. The solution may be heated at 40° C. for thirty minutes. The solution may then be removed and the fabric may be rinsed five times with water to yield the final silver nanoparticle impregnated cloth.

In another example, 20 mL of silver nanoparticles functionalized with polysorbate 20 (Tween 20) may be added to 200 mL of water and mixed and heated to 45° C. To this, 1.2 g of cyanuric chloride may be added and mixed for five minutes. To this, 150 $cm^2$ of rayon cloth may be added and the mixture allowed to agitate for twenty minutes at 45° C. The cloth may then be removed and rinsed thoroughly to yield the final functionalized cloth.

In an alternative embodiment, functionalized nanoparticles may provide improved filtration in heating, ventilation, and air conditioning products. Ventilation systems, air ducts, and other components of heating, ventilation, and air conditioning may also benefit from the antimicrobial properties of certain functionalized metal nanoparticles.

In an alternative embodiment, the electrical conductivity properties of functionalized metal nanoparticles may used as nanowires or in nanoelectronics. Such embodiments include use of functionalized metal nanoparticles as nanowires in polymers, glass, semiconductors, circuitry, wiring, and electronic devices, or in nanoelectronic devices, services, or procedures, including medical, forensic, data analysis, or other purposes.

Embodiments may also use the optical properties of functionalized nanoparticles, for example, to provide improved data storage systems, optical data transmission devices, optical laser systems, and in electronic devices.

Furthermore, functionalized nanoparticles as described may comprise beneficial self-assembly properties. For example, functionalized nanoparticles may be functionalized via a linker molecule and electrolytes to form multi-layer films with one or more layers. In an embodiment, alternating cationic and anionic monolayers are covalently or electrostatically bonded between neighboring functionalized nanoparticles, resulting in consistent tunnel junctions that provide improved electrical conductivity at the nanometer scale. Embodiments based on self-assembly properties of functionalized nanoparticles include nanowires, nanoelectronics, and devices that use nanoelectronics and wires.

In another embodiment, a composite catalyst coating may be provided in which multiple metallic nanoparticles, such as Co, Cu, Ru, Pt, etc. may be incorporated into one or more coating layers. In an embodiment, such coatings may be deposited on a metal or metal oxide support. In an embodiment, such coatings may be useful for coatings in microreactors. Utilizing embodiments herein, robust substrate coatings may be provided with composites of catalysts as described above.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A functionalized substrate comprising:

a functionalized nanoparticle comprising a metal core and a metal oxide shell;

a substrate; and a linker molecule having a first functionality bound to the functionalized nanoparticle and a second functionality bound to the substrate, wherein the substrate comprises at least one of a cellulosic substrate, cotton, linen, rayon, nylon, polyester, wood, paper, cardboard and cellophane.

2. The functionalized substrate of claim 1, wherein the functionalized nanoparticle comprises at least one of aluminum, iron, silver, zinc, gold, copper, cobalt, nickel, platinum, manganese, rhodium, ruthenium, palladium, titanium, vanadium, chromium, molybdenum, cadmium, mercury, calcium, zirconium, iridium, and oxides thereof.

3. The functionalized substrate of claim 1, wherein the functionalized nanoparticle comprises a reactive functionality, wherein the reactive functionality is at least one of an azide, an acyl azide, vinyl chloride, cyanuric chloride, vinyl sulfone, or an isocyanate.

4. The functionalized substrate of claim 1, wherein the linker molecule comprises at least one of an azide, vinyl chloride, cyanuric chloride, vinyl sulfone, and an isocyanate.

5. The functionalized substrate of claim 1, wherein the functionalized nanoparticle comprises at least two different types of functionalized nanoparticles.

6. The functionalized substrate of claim 1, wherein the functionalized nanoparticle has a reactive functionality that binds directly to the nanoparticle and binds to the linker molecule.

7. A functionalized substrate comprising:

a functionalized nanoparticle, comprising a metal core and a metal oxide shell, wherein the functionalized nanoparticle has a reactive functionality bound directly to the nanoparticle;

a substrate; and a linker molecule having a first functionality bound to the reactive functionality of the functionalized nanoparticle and a second functionality bound to the substrate, wherein the substrate comprises at least one of a cellulosic substrate, cotton, linen, rayon, nylon, polyester, wood, paper, cardboard and cellophane.

8. A functionalized substrate comprising:

a plurality of functionalized nanoparticles comprising at least two different types at least one of the plurality of functionalized nanoparticles comprises a metal core and a metal oxide shell;

a substrate; and a plurality of linker molecules, each linker molecule having a first functionality bound to one of the plurality of functionalized nanoparticles and a second functionality bound to the substrate, wherein the substrate comprises at least one of a cellulosic substrate, cotton, linen, rayon, nylon, polyester, wood, paper, cardboard and cellophane.

9. The functionalized substrate of claim 8, wherein the two different types of functionalized nanoparticles bind to two different linker molecules by two different reactive functionalities.

* * * * *